US010096459B2

(12) United States Patent
Grothe, Jr.

(10) Patent No.: US 10,096,459 B2
(45) Date of Patent: Oct. 9, 2018

(54) MASS FILTERING OF IONS USING A ROTATING FIELD

(71) Applicant: DH Technologies Development Pte. Ltd., Singapore (SG)

(72) Inventor: Robert Alois Grothe, Jr., Campbell, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/513,262

(22) PCT Filed: Sep. 21, 2015

(86) PCT No.: PCT/IB2015/057261
§ 371 (c)(1),
(2) Date: Mar. 22, 2017

(87) PCT Pub. No.: WO2016/055887
PCT Pub. Date: Apr. 14, 2016

(65) Prior Publication Data

US 2017/0278693 A1 Sep. 28, 2017

Related U.S. Application Data

(60) Provisional application No. 62/061,491, filed on Oct. 8, 2014.

(51) Int. Cl.

| | |
|---|---|
| ***H01J 49/42*** | (2006.01) |
| ***H01J 49/10*** | (2006.01) |
| ***H01J 49/00*** | (2006.01) |

(52) U.S. Cl.
CPC ..... *H01J 49/421* (2013.01); *H01J 49/0031* (2013.01); *H01J 49/10* (2013.01)

(58) Field of Classification Search
CPC ..... H01J 49/421; H01J 49/0031
See application file for complete search history.

(56) References Cited

U.S. PATENT DOCUMENTS

| | | | |
|---|---|---|---|
| 2005/0040329 | A1 | 2/2005 | Farnsworth |
| 2006/0011828 | A1 | 1/2006 | Livi |
| 2006/0219933 | A1 | 10/2006 | Wang |

(Continued)

OTHER PUBLICATIONS

International Search Report and Written Opinion for PCT/IB2015/057261, dated Feb. 19, 2016.

*Primary Examiner* — Eliza Osenbaugh-Stewart
(74) *Attorney, Agent, or Firm* — John R. Kasha; Kelly L. Kasha; Kasha Law LLC

(57) ABSTRACT

Systems and methods for filtering a continuous beam of ions are provided. An acceleration electric field is applied to a continuous beam of ions using an accelerator to produce an accelerated beam of ions. A field is applied to the accelerated beam to separate ions in time and space using a deflector producing a separated beam of ions. The field applied by the deflector is a rotating field or a circulant rastering field. The rotating field can be a rotating magnetic or electric field. Only accept those ions from the separated beam whose m/z values lie within a range centered around a target m/z value using an aperture. The aperture can include a pinhole aperture in a rotating disk or an annular aperture in a first stationary disk, a second deflector, and a pinhole aperture in the center of a second stationary disk.

7 Claims, 9 Drawing Sheets

(56) References Cited

U.S. PATENT DOCUMENTS

| | | | | |
|---|---|---|---|---|
| 2009/0189096 | A1 | 7/2009 | Chen et al. | |
| 2012/0112060 | A1* | 5/2012 | Kinugawa | H01J 49/408 250/287 |
| 2012/0312982 | A1* | 12/2012 | Webb | H01J 49/401 250/282 |
| 2013/0119263 | A1 | 5/2013 | Smick et al. | |
| 2015/0380227 | A1* | 12/2015 | Hotta | H01J 37/05 250/291 |

* cited by examiner

100

900

MASS FILTERING OF IONS USING A ROTATING FIELD

CROSS REFERENCE TO RELATED APPLICATION

This application claims the benefit of U.S. Provisional Patent Application Ser. No. 62/061,491, filed Oct. 8, 2014, the content of which is incorporated by reference herein in its entirety.

INTRODUCTION

A mass spectrometer is often used to analyze a complex mixture of various chemical compounds. The goals of analysis may be qualitative and/or quantitative: to identify each chemical compound in the mixture (qualitative analysis) and to quantify all compounds (non-targeted quantification) or certain compounds of interest (targeted quantification). A versatile mass spectrometer design for addressing these analytical goals typically consists of the following five sequential components: 1) an ion source; 2) a mass filter; 3) a fragmentation cell; 4) a mass analyzer; and 5) an ion detector.

An ion source transfers molecules (intact) from the aqueous phase in the sample to the gas phase, both desolvating the molecule and placing an electrical charge on it (most often by attaching one or more protons) to form an ion that can be manipulated by electric fields, and/or magnetic fields. A mass filter, more precisely a mass-to-charge filter is used to select ions whose mass-to-charge ratio lies within a specified narrow range to allow the instrument to characterize these ions (or in some cases, a single targeted ion) without being overwhelmed by the full complexity of the mixture.

A fragmentation cell is used to form product ions from each intact precursor or molecular ion in a predictable fashion that can serve as a diagnostic fingerprint for each molecular ion. A mass analyzer, more precisely a mass-to-charge (m/z) analyzer, is used to separate the product ions in time and/or space on the basis of mass-to-charge ratio. In some cases, the mass analyzer is replaced by a second mass filter, targeting a particular product ion, just as the first mass filter targeted a particular intact (or precursor) molecular ion. Finally, a detector records the arrival time and/or position of each product ion.

This type of mass spectrometer design makes up a majority of mass spectrometers sold today, including the QqTOF, QqFT, and QqQ, where the upper-case "Q" at the front denotes a quadrupole acting a mass filter, the lower-case "q" in the middle denotes a quadrupole used as a fragmentation cell, and TOF, Q, and FT denote various mass analyzers: time of flight, quadrupole, and Fourier transform, respectively.

In a QqQ, often referred to as a tandem mass spectrometer, a triple-quadrupole mass spectrometer, or a "triple quad", the last "Q" is often operated as a mass filter, rather than a mass analyzer, to perform targeted quantification as mentioned above. Some mass spectrometers use an ion trap rather than a quadrupole as a mass filter and/or mass analyzer.

There is currently a need in the art for a mass filter that is capable of selecting ions in the narrowest possible range of mass-to-charge value, while, at the same time, maximizing the transmission efficiency of ions in this narrow range. The sensitivity of detection, the quantitative accuracy, and/or analytic throughput are improved when the ion transmission efficiency increases. The specificity of the analysis is improved when the filter limits are narrowed.

In qualitative analysis, identification of chemical compounds is most reliable when most of the detected product ions arise from a single chemical component. In contrast, the presence of product ions from multiple precursors often confounds algorithms for identification.

In targeted quantitative analysis, the assay for the target compound is to select the precursor ion and one of its product ions. Unwanted compounds ("interferences") that by chance have both a precursor mass and form a product ion mass that fall within the respective mass filter windows cause large systematic errors in the assay. The presence of errors due to interferences may, or may not, be detected.

Typically, mass filters (whether implemented by a quadrupole or an ion trap) are typically operated at "unit resolution" (an isolation width of 0.7 Da). The transmission efficiency for a typical commercial quadrupole at unit resolution is about 20-50%. A quadrupole can be operated to deliver higher resolution (i.e. a narrower mass window), but at the cost of a reduction in transmission that is much faster than linear in the narrowing of the window.

Because chemical compounds have clustered "mass defects" (the part of the mass to the right of the decimal point), there is often little benefit in reducing the mass filter width (aka isolation width) to less than 0.7 Da until the isolation width is less than the width of these mass defect clusters (i.e. <0.2 Da). However, conventional mass filters are incapable of delivering such narrow isolation windows without intolerably large losses of ions.

SUMMARY

A system is disclosed for filtering a continuous beam of ions. The system includes an accelerator, a deflector, and an aperture.

The accelerator receives a continuous beam of ions and applies an acceleration electric field to the continuous beam of ions producing an accelerated beam of ions. The deflector applies a field to the accelerated beam to separate ions in time and space producing a separated beam of ions. The aperture accepts only those ions from the separated beam whose m/z values lie within a range centered around a target m/z value.

A method is disclosed for filtering a continuous beam of ions. An acceleration electric field is applied to a continuous beam of ions using an accelerator to produce an accelerated beam of ions. A field is applied to the accelerated beam to separate ions in time and space using a deflector producing a separated beam of ions. Only those ions from the separated beam whose m/z values lie within a range centered around a target m/z value are accepted using an aperture.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
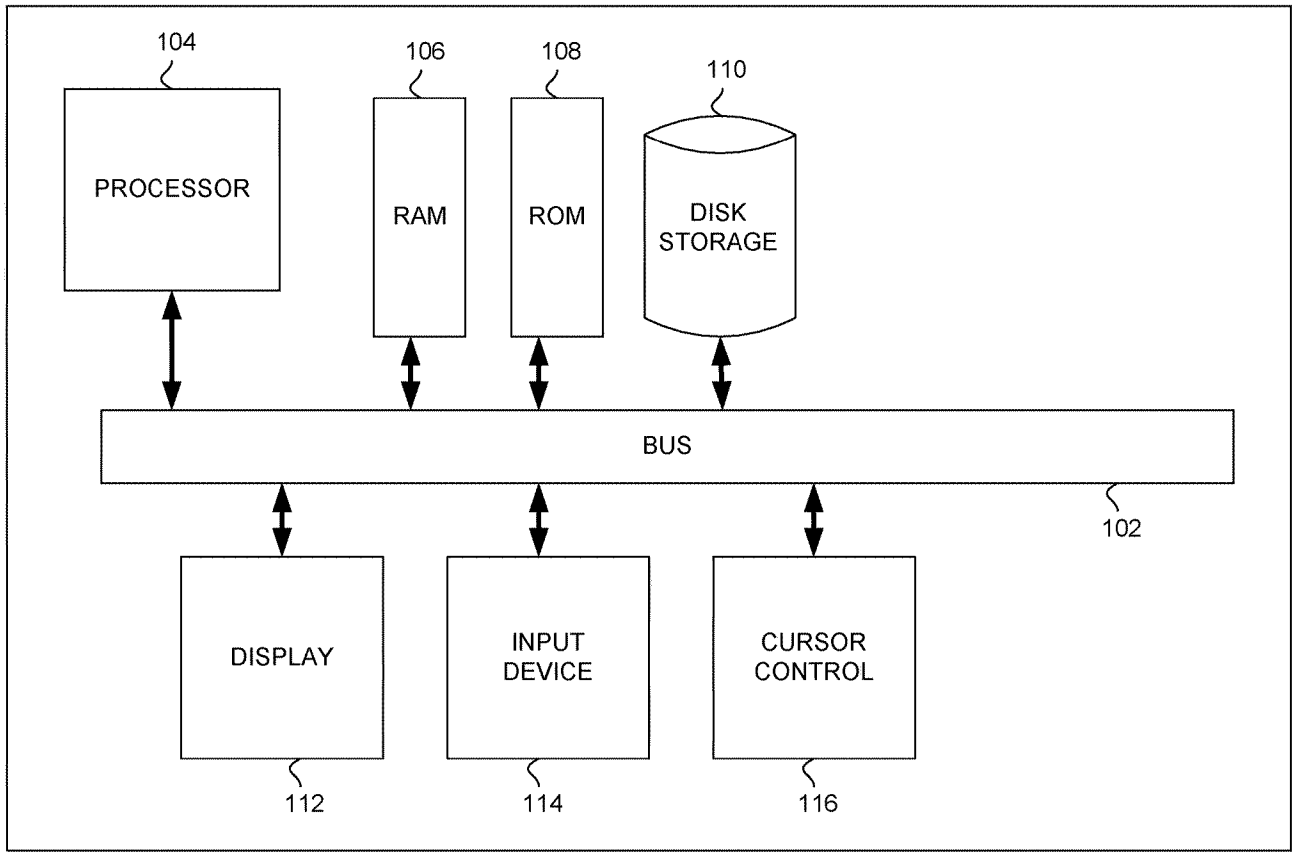
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Filtering Ions by Mass

As described above, the quadrupole mass filter, which is most commonly used for ion isolation in mass spectrometry, suffers from poor ion transmission for narrow windows, effectively limiting its use to isolation widths of 0.7 Da (700 mDa) or greater. Isolation windows that are sufficiently narrow to separate ions of the same nominal mass (i.e. <200 mDa) have such low transmission efficiency as to be generally unusable. The use of injection waveforms in ion traps is also incapable of isolating narrow windows.

In various embodiments, systems and methods for isolating ions using an aperture downstream from one or more rotating fields offer a way to isolate ions from narrow isolation windows without compromising ion transmission. These systems and methods can achieve isolation of narrow mass ranges (100 mDa or less) with very high transmission, up to 100%.

A co-pending application describes systems and methods of separating a continuous beam of mono-energetic ions using an appropriately chosen field that rotates in a plane normal to the beam direction. In these systems and methods, ions that arrive simultaneously in any plane downstream from the rotating field and normal to the beam lie in a spiral pattern. There is a continuous mapping of successively higher mass-to-charge ratios along the arc length of the spiral as it is traced inward. In the co-pending application, this principle of ion separation was recognized as beneficial for mass analysis. In the current application, the same principle is exploited for mass-selective ion filtering or isolation.

Background: Separating Ions Using a Rotating Field

A rotating field normal to the direction of a continuous beam of mono-energetic ions is to separate these ions in three dimensions. The first dimension of separation is along the axis of the ions' initial velocity. Heavier ions have lower velocity than lighter ions of the same kinetic energy. Over time, lighter ions run away from heavier ions. This axial separation is independent of the rotating field and is the basis for mass analysis in conventional TOF mass spectrometry. The other two transaxial dimensions of separations are directly induced by the rotating field.

With respect to a fixed transaxial plane downstream from the rotating field, positions of ions in the plane are most naturally expressed in polar coordinates. The angular displacement in the plane is the angular displacement of the direction of the rotating field when the ion passed through the (midpoint of) field. For example, if the field was pointing in the 12 o'clock when the ion passed through the field, the ion arrives at the 12 o'clock position on the detector. By rotating the field faster, separation of ions with smaller m/z differences can be achieved. However, times of flight values greater than one rotation period are not mapped to unique angular displacements.

When the properties of the rotating field are chosen appropriately, as described in the co-pending application, the radial displacement of an ion in the transaxial plane can be used to resolve ambiguity in its time of the flight (and thus its m/z) that would arise from measuring the angular displacement of the ion alone For example, heavier (i.e. higher m/z) ions have a smaller radial displacement that lighter ions of the same energy in a magnetic field.

In an electric field, mono-energetic ions that experience the same field for the same duration of time would undergo the same radial deflection. However, heavier (i.e. higher m/z) ions have a smaller radial displacement in an electric field of such limited axial extent that the ion's effective transit time through the field is less than one rotation period.

In this case, m/z-dependent radial separation of mono-energetic ions results from differences in averaging the field vector over the transit time of the ion through the field. Increasing the transit time up to one rotation period results in a monotonic decrease in the radial displacement of the ion.

For example, ions that spend a full rotation period in the rotating field undergo no deflection because the forces average to zero. At the other extreme, ions that pass instantaneously through the field undergo no averaging and undergo the same deflection as if the field were static. The range of ion transit times that provide sufficient radial separation for mass analysis and mass filtering is about 0.2 to 0.8 rotation periods, which corresponds to a high mass that is sixteen times the lowest mass.

The radial displacement of the ion changes relatively slowly with m/z. For mass analysis and mass filtering, it is required that ions whose time of flight differs by one rotation period (by virtue of their differing mass-to-charge) are separated by at least the diameter of the ion beam's image on the detector. The operating parameters can be adjusted, e.g. reducing the rotation period, to satisfy this requirement.

Viewed from the perspective of a transaxial plane (parallel to the plane of the rotating field) downstream from the rotating field, ions that arrive in the plane at the same time are arranged in a spiral pattern. Two ions on adjacent rings of the spiral differ by one rotation period of the field. The width of rings in the spiral is equal to the beam diameter. For mass analysis, the spacing between rings must exceed the beam diameter to prevent overlaps that would lead to ambiguity in assigning m/z to ions. For mass filtering, overlaps in this spiral pattern would represent acceptance of ions at a different m/z in addition to the target m/z.

It was recognized in the co-pending application, that the separation of ions could be used for time-of-flight (TOF) analysis of a continuous beam of ions. The position of each ion in the plane indicates the time of departure, measured with respect to the axial midpoint of the deflection field. The time of arrival is measured as in conventional TOF analysis. The time of flight is calculated by simply subtracting the time of arrival from the time of departure, also as in conventional TOF analysis.

The difference between the rotating-field analyzer and a conventional TOF analyzer is that the rotating-field analyzer does not bunch ions into pulses and therefore, is capable of measuring the flight times of ions in a continuous, uninterrupted beam.

The difference between these TOF analyzers can be most easily understood in terms of the analogy of a race. In a conventional TOF analyzer, the ions are lined up at the starting line, the starter's pistol is fired (i.e. an accelerating potential is turned on), and the time from the start signal to ion arrival at the finish line is measured. In contrast, in the rotating-field analyzer, the ions are accelerated as a continuous beam and subsequently "run" up to the starting line (the rotating field). As each ion crosses the starting line, it carries a time-stamp that is encoded by its position of arrival in the plane of the array detector.

Over time, the entire spiral pattern rotates as a rigid object in the transaxial plane at the same frequency as the rotating field. The arrival position of ions with a given mass-to-charge ratio rotates at the same frequency as the rotating field and at a constant radius tracing out a circular trajectory.

The phase relation between the instantaneous direction of the deflector field and the angular displacement of the ion in the plane is $2\pi$ times the ion's time of flight divided by the period of the rotation field. For example, an ion with a time of flight that is an integer multiple of the rotation field will rotate in phase with the deflection field (i.e. the phase difference is an integer multiple of $2\pi$, which is zero modulo $2\pi$).

Figure 2:
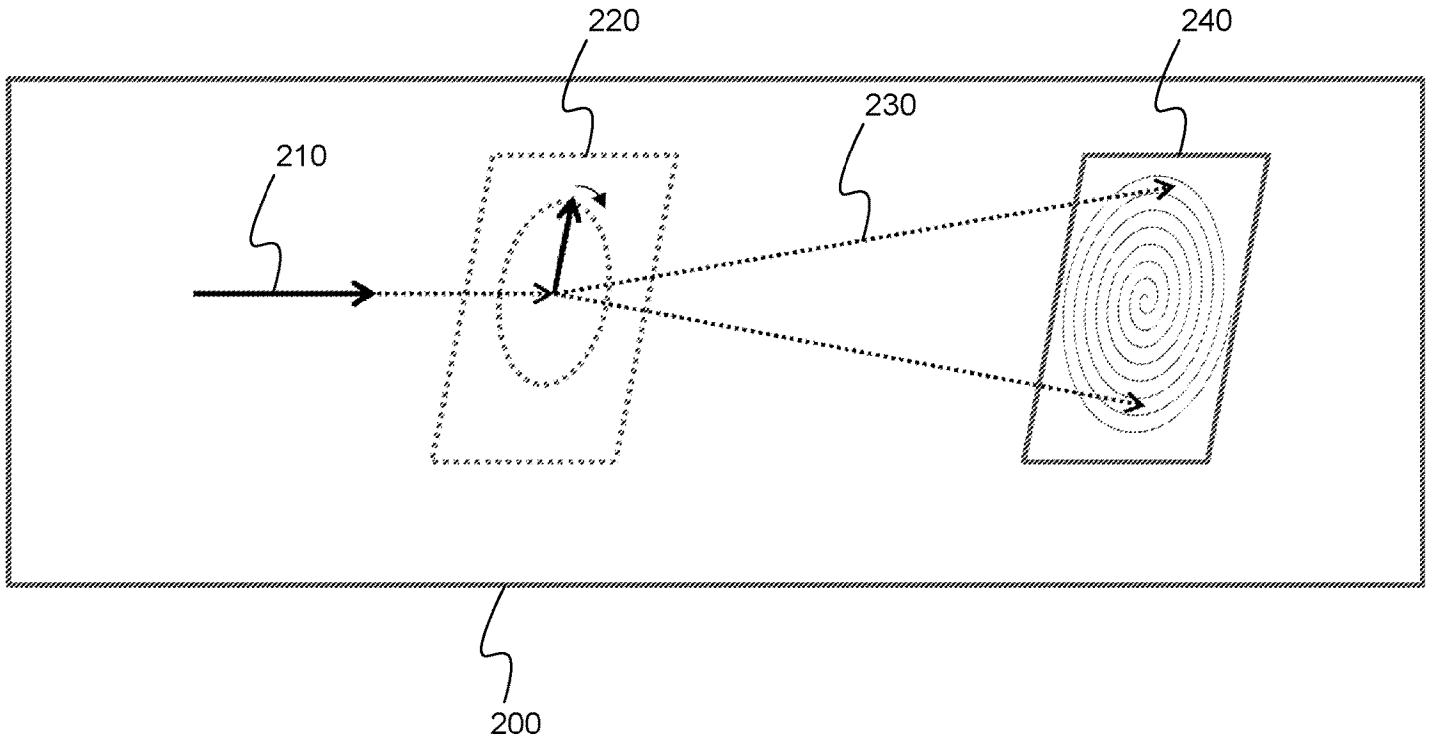
FIG. 2 is exemplary diagram of a mass analyzer with a rotating deflection field, in accordance with various embodiments.

FIG. 2 is exemplary diagram of a TOF mass analyzer 200 with a rotating deflection field, in accordance with various embodiments. In the TOF mass analyzer 200, a continuous, accelerated beam of ions 210 is directed into a rotating field (magnetic B or electrical E) 220, causing deflection 230, whose radial component is mass-to-charge dependent and whose angular component depends upon the time of arrival in the field.

At any instant in time, ions form a spiral pattern on a planar detector 240. Ions at the same angular displacement, but on adjacent rings of the spiral, have a TOF difference of one rotation period of the deflection field. Ions on the same ring of the spiral (arriving at the detector at the same time) have a time of flight differences less than one rotation period; the relative angular displacements of these ions reflect their passage through the deflector at different times. The entire spiral pattern rotates (as a rigid object) at the same frequency as the rotating deflection field.

Ion separation by a rotating field is an example of separation of ions by a time-varying field. Another example is a raster-scanned electric field. Many of the principles described above for the rotating field are the same for the raster-scanned electric field, except that the trajectory of positions in a transaxial plane traced out by ions of a given mass-to-charge ratio follows a raster trajectory rather than a circular trajectory. Mass filtering ions is facilitated by the geometric simplicity of the circular trajectory of ions of a given m/z produced in a downstream plane by a rotating field.

In regard to a raster-scanned electrical field, the deflector is a time-dependent electric field that sweeps the ion beam across the detector array in a circulant raster pattern. A raster pattern consists of continuous back-and-forth motion of the beam along one axis of the detector array while the beam is stepped in the orthogonal direction by one beam diameter each time a new row is completed. A circulant raster refers to connecting two ends of the raster to form a closed loop.

Figure 3:
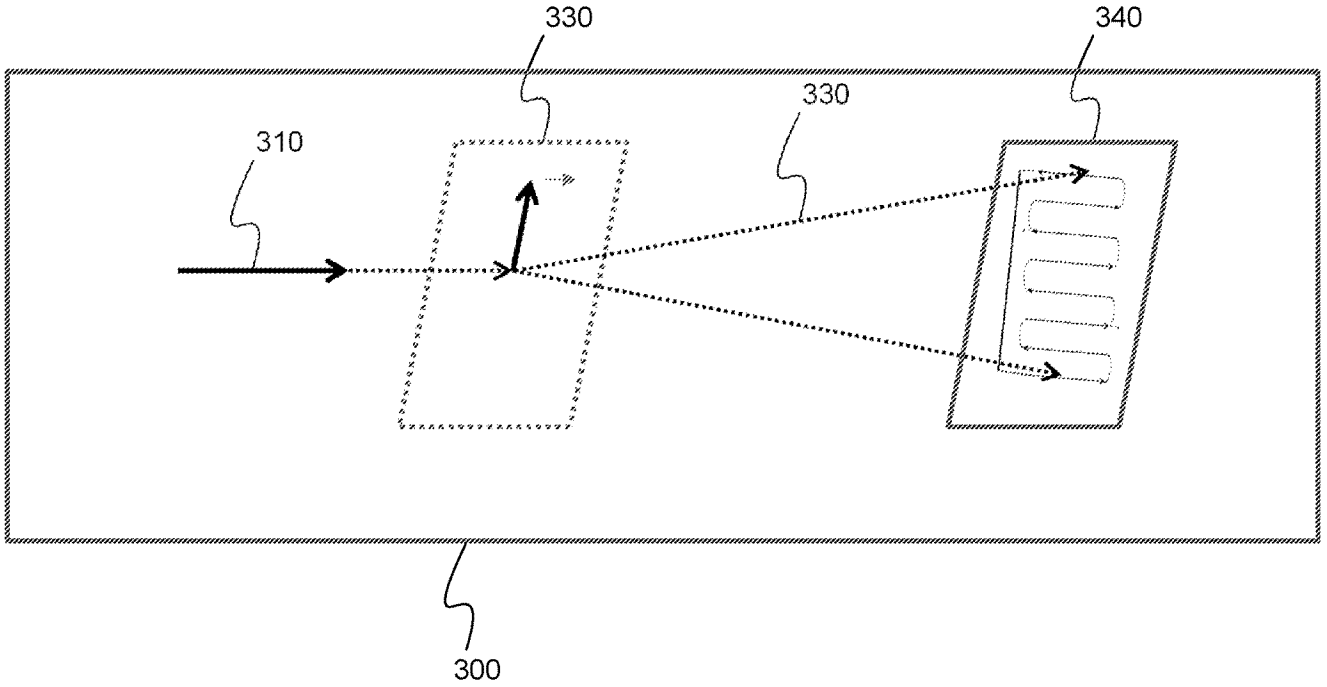
FIG. 3 is exemplary diagram of a mass analyzer with a raster scanned electrical field, in accordance with various embodiments.

FIG. 3 is exemplary diagram of a TOF mass analyzer 300 with a raster-scanned electrical field, in accordance with various embodiments. In the mass analyzer 300, a continuous, accelerated beam of ions 310 is directed into a dynamically varying deflection field 320 causing mass-to-charge ratio (m/z) dependent separation of ions 330, which strike a planar detector 340. In this embodiment, the time-dependence of the deflection field is designed to form a raster pattern on the detector.

The repeat rate of the entire raster pattern is matched to the TOF difference between the lightest and heaviest ions. Ions of different m/z that arrive at the same time are distributed along the raster pattern, reflecting various positions of the deflection field at the various times that these ions passed through. Over time, the entire pattern processes in a serpentine-like motion over time along the same path.

Collection Aperture

In various embodiments of a mass filter, the detector array of a TOF mass analyzer that uses a rotating field to separate ions is replaced by collection aperture or collector apparatus to select or isolate ion species in a narrow range around a target m/z value. The deflector field can be a rotating field or a circulant rastering field, for example. The collection aperture changes the radius and angular position of the aperture along with the deflector field.

Grid Aperture for Circulant Rastering Field

In various embodiments, a grid aperture is used to change the radius and the angular position of an aperture for a circulant rastering field. Different fields or currents are applied to wires on this grid to move a hole in the grid both radially and angularly in space dynamically as a function of time. By moving the hole around both radially and angularly, the selected ions pass through the hole as the continuous beam of ions is rastered across the grid. In various embodiments, selected ions can further be deflected to a single detector by a second deflector field, for example.

Aperture for Rotating Field

A rotating field separates a continuous beam of ions in both time and space in a way that is useful for mass analysis. This same separation of ions can be exploited for mass filtering—transmitting ions whose mass-to-charge ratios lie within a selected range and blocking transmission of all other ions.

The key features of the separation of ions by a rotating field that are relevant to various embodiments are the following:

1) ions of a given mass-to-charge ratio trace out a circular pattern on the detector;

2) the radius of the circle depends upon the mass-to-charge ratio of the ion and is scaled by the magnitude of the deflection field;

3) the frequency of the circular trace is the same as the frequency of the rotating deflection field; and 4) the angular displacement between the direction of the deflection field and the position of the ion strike depends upon the remainder of the ion's time of flight when divided by the rotation period.

Figure 4:
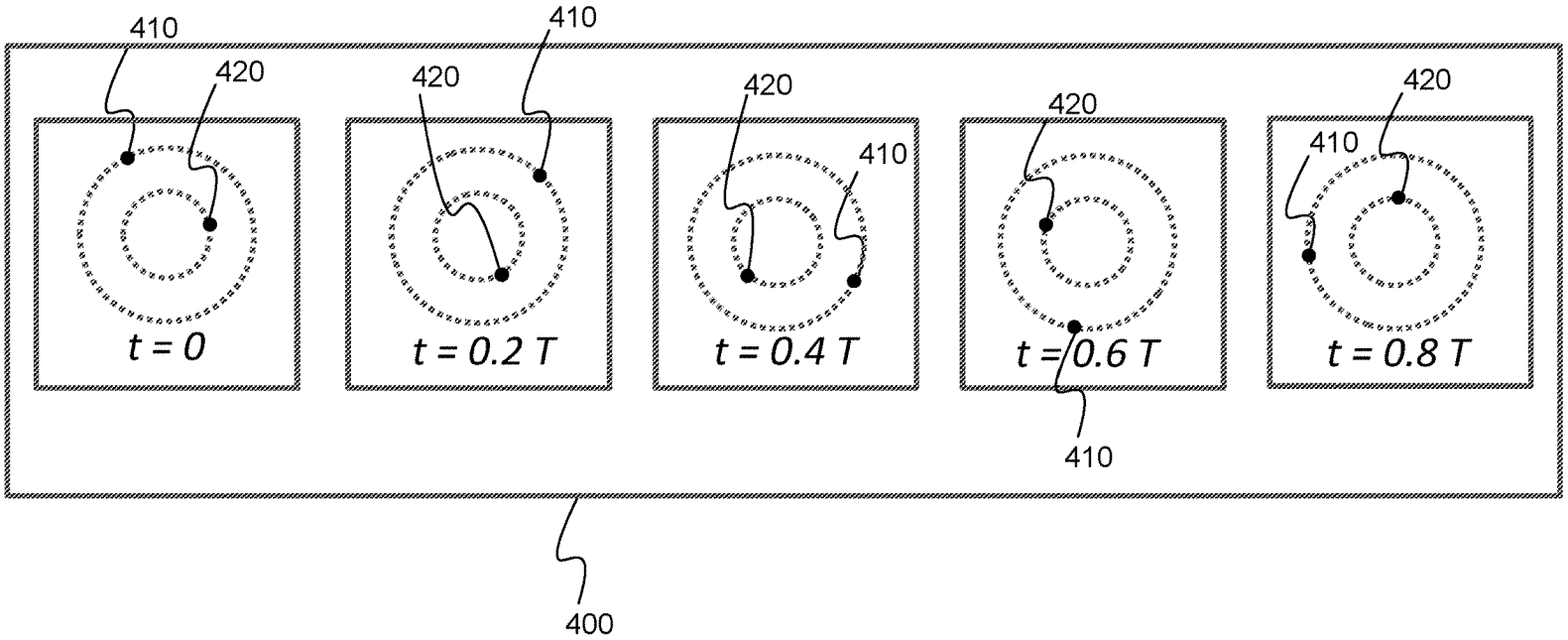
FIG. 4 is an exemplary time series showing ion positions in a detector plane for two selected ions deflected by a rotating field, in accordance with various embodiments.

FIG. 4 is an exemplary time series 400 showing ion positions in a detector plane for two selected ions deflected by a rotating field, in accordance with various embodiments. The positions of two ions 410 and 420 with distinct m/z values are depicted at five different times in time series 400. The radial component of the ion deflection depends upon m/z and the strength of the deflection field, which does not change with time. Therefore, each ion traces out a circle on the detector during one rotation period of the deflection field (T). From one panel to the next, the time step is 0.2 T, corresponding to an angular displacement of each ion on its respective circle of 0.2 (360°)=72°.

In various embodiments, it is recognized that the separation of ions in time and space by a rotating deflection field can be used for mass filtering of ions. In relation to the rotating-field mass analyzer, a collector apparatus replaces the detector array with a selection apparatus that transmits only the target ion and blocks all other ions.

Figure 5:
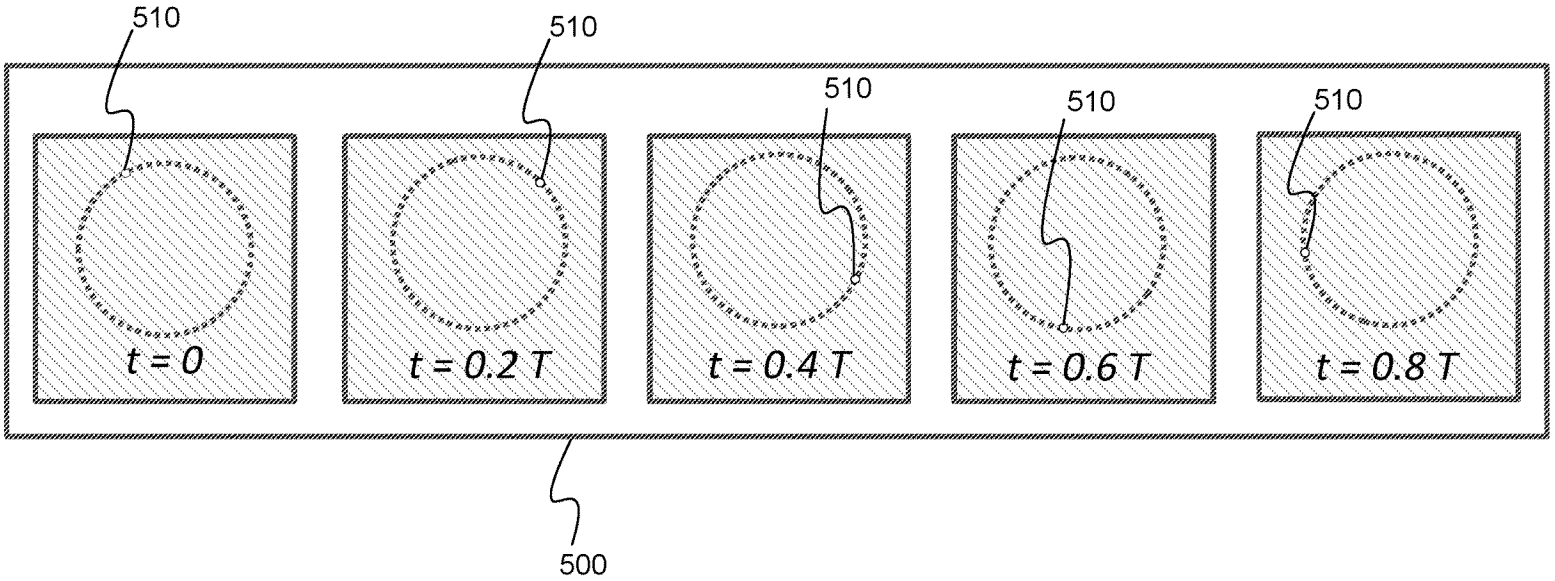
FIG. 5 is an exemplary time series showing an aperture time course required to select an ion with a desired mass-to-charge ratio following the ion's deflection by a rotating field, in accordance with various embodiments.

FIG. 5 is an exemplary time series 500 showing an aperture time course required to select an ion with a desired mass-to-charge ratio following the ion's deflection by a rotating field, in accordance with various embodiments. To select an ion with a desired mass-to-charge ratio, i.e., to transmit only ions of a desired mass-to-charge ratio and block all other ions, an aperture 510 is placed at the position where the desired ions arrive at each instant of time. All areas other than aperture 510 are impenetrable to ions. The dashed circle indicates the trajectory of the aperture (white circle) over time required to transmit an ion with a desired mass-to-charge ratio. The frequency of rotation of aperture 510 matches the rotation frequency of the deflection field. Both the required radial displacement of the aperture and its phase are m/z dependent. Aperture 510 is used to select ion 410 of FIG. 4, for example.

In various embodiments, the collector is simplified by bringing the ions to the collector, to varying extents, rather than entirely bringing the collector to the ions. Ions with a target m/z value cannot be brought to a static collector because their position moves around a circle over time.

The radius of this circular trajectory for a given m/z is m/z-dependent when the rotating field that induces this trajectory is kept at a fixed magnitude. It is easier to construct an aperture at a fixed radial displacement, rather than to change its radial displacement for each distinct m/z target. Because the radial displacement of an ion scales linearly with the strength of the applied field, an ion of any m/z can be deflected to a fixed radial displacement by simply scaling the field strength as required to target a given m/z.

As stated above, the phase difference between the direction of the rotating field and the angular displacement of an ion in a downstream transaxial plane is $2\pi$ times the ion's time of flight divided by the rotation period. Mass filtering can be made easier if an aperture can be operated at a fixed phase difference from the rotating field, rather than constantly adjusting this phase difference for each target m/z. For example, a phase difference of zero would allow us to drive both the rotating field for separating ions and an aperture for collecting ions with the same input signal.

The phase difference between the direction of the rotating field and the angular displacement of the ion can be adjusted by either changing the ion's time of flight or the rotation period of the field and the collector. It is preferable to set the rotation in motion and to leave it undisturbed. The time of flight of the ion can be changed by changing the distance of flight or the velocity of the ion. Adjusting the ion's velocity by adjusting the acceleration potential is preferred.

The acceleration potential for each target m/z can be adjusted so that, for example, the time of flight of an ion of the target m/z is an integer multiple of the rotation period. In this case, the position of ions of the target m/z rotates in phase with the rotation field. The rotation of the aperture would be kept in phase with the deflection field.

Two embodiments are disclosed of an apparatus to select a target ion species after the ions have been separated in time and space by the application of a rotating deflector field:

1) a pinhole collection aperture placed in a disk rotating synchronously with the deflector field; and 2) a ring-shaped slot placed in a fixed disk for radial selection followed by a collector field that rotates synchronously with the deflection field to achieve time-dependent angular selection by sending the target ion into a centrally positioned collection funnel and sending other ions away from the acceptance region of the funnel.

Both embodiments select ions that have a fixed radial displacement. In contrast, an important feature of mass analysis using a rotating field is that the radial displacement of ions is m/z dependent. An important feature of both embodiments for mass filtering of ions is that the deflection field can be scaled to bring a target ion species of arbitrary m/z to a fixed radial displacement. The apparatus is greatly simplified by allowing selection of ions at a fixed radial displacement.

In summary, given a desired m/z value for mass filtering, first the acceleration potential is adjusted to move the time of flight for ions of the desired m/z to the nearest integer multiple of the rotation period. Next, the magnitude of the rotating field is scaled to bring the radial displacement of the ion to the fixed radial displacement of the aperture.

Another common feature shared by the two embodiments is the use of a collector element that rotates synchronously with the rotating deflector field. Operating the rotating collector element synchronously with the deflector field, i.e., at the same frequency and with a fixed phase offset, also simplifies design. For example, the same sinusoidal signal that drives the deflector can also be used to drive the collector. An important feature of separation of ions by a rotating field is that the angular displacement between the position of an ion in a given plane and the position of the deflection field at its time of impact is constant over time, but m/z dependent. The angular position of the ion can be placed on the collector at a fixed angular displacement from the deflection field (e.g., 0 or 180 degrees) by making a small adjustment to the acceleration potential, which in turn adjusts the time of flight of the ion.

For example, if the time of flight is exactly an integer multiple of the rotation period, then the angular displacement of the ion on the collector is parallel to the instantaneous direction of the deflection field. That is, the deflection field has completed as integer number of rotations in the time the ion flew from the deflector to the collector, and so the deflector was pointing in the same direction when the ion reached the collector as it was when it deflected the ion.

Pinhole Aperture on a Rotating Disk

Figure 6:
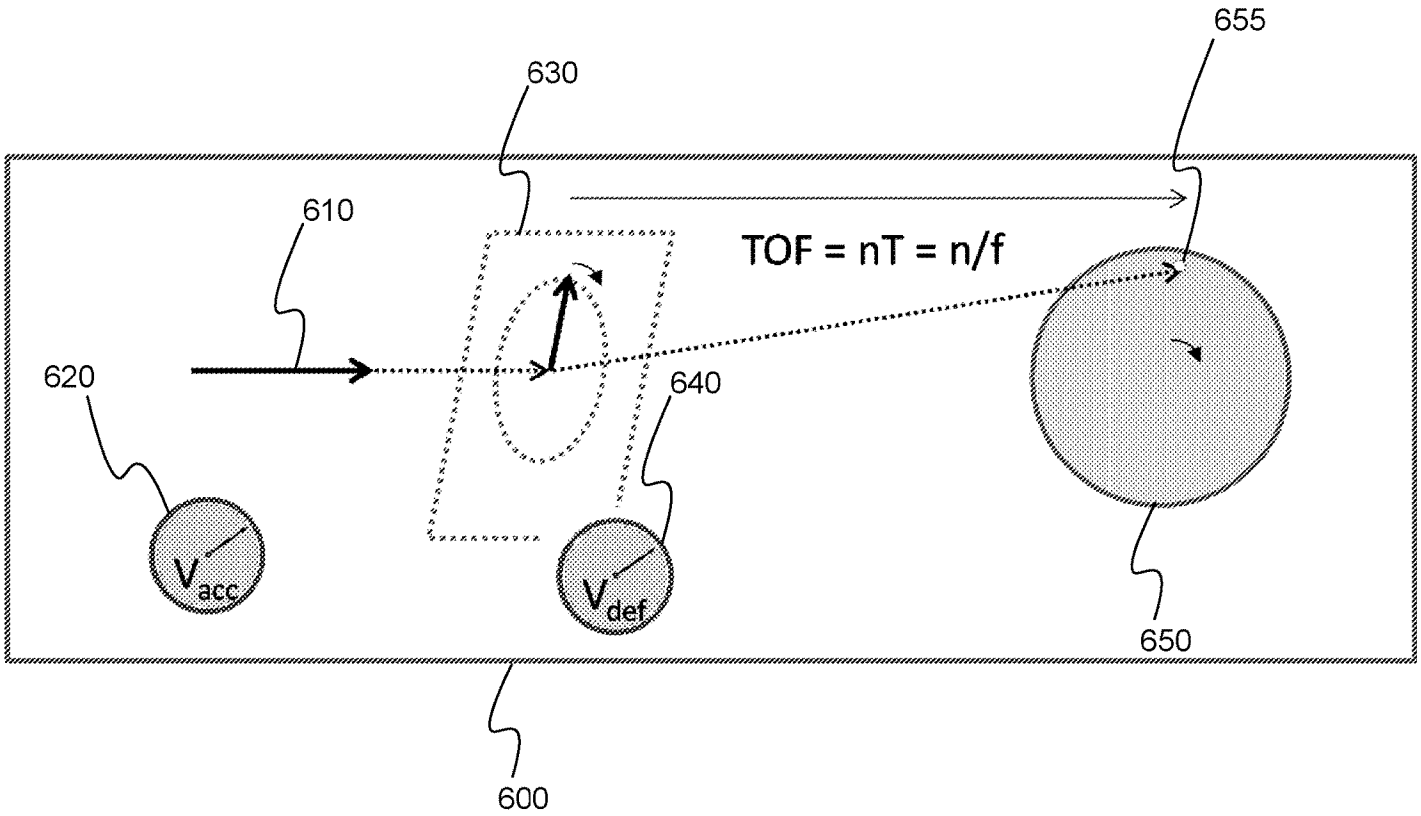
FIG. 6 is an exemplary diagram of a mass filter that includes a rotating mechanical aperture, in accordance with various embodiments.

FIG. 6 is an exemplary diagram of a mass filtering apparatus 600 that includes a rotating mechanical aperture, in accordance with various embodiments. In mass analyzer 600, a continuous beam of accelerated ions 610, controlled by a tunable acceleration voltage ($V_{acc}$) 620 is directed into a rotating deflection field 630. The magnitude of the field is controlled by a tunable deflection voltage ($V_{def}$) 640. Ions in continuous beam 610 are separated by m/z. In mass filter 600, the detector is replaced by rotating disk 650 with a pinhole aperture 655. Ions with the desired m/z are directed into the aperture and all other ions are directed onto disk 650 and away from aperture 655.

To deliver ions of a desired m/z to aperture 655: 1) disk 650 is rotated at the same frequency as deflection field 630, keeping the position of aperture 655 in the plane of disk 650 aligned (i.e. in phase) with deflection field 630; 2) the acceleration voltage 620 is adjusted (by a few percent) so that the time of flight between deflection field 630 and aperture 655 for the desired ions is an integer number of the rotation period; and 3) the magnitude of deflection field 630 is scaled so that the radial deflection of the desired ions is matched to the radial displacement of aperture 655.

Conceptually, a hole in a rotating disk is a simple embodiment. The position of the hole tracks the position of the target ion over time. The size of the hole is matched to the cross-section of the ion beam in the plane of the disk. The disk is spun up to a constant angular velocity and only small impulses are required to keep the angular displacement of the pinhole in alignment with the current position of the deflector field.

The resolving power of the mass filter increases with the speed of aperture, i.e., the product of its angular velocity and its radial displacement from its axis of rotation. Likewise, the stress on the rotating disk at its center generated by centrifugal forces also increases with its edge speed. Because the stress on the disk that can be tolerated before material failure limits the edge speed, the resolving power of the aperture is maximized by placing it as close to the edge of the disk as practicable.

A brief analysis of the performance of this mass filtering method is provided below.

To simplify the analysis, suppose that any population of ions with the same mass-to-charge ratio is focused onto the plane of the disk to form a circular spot of uniform density and whose radius is independent of m/z. It is assumed that the spot is properly aligned to the aperture by first adjusting the angular displacement of the ion by adjusting the acceleration potential and then adjusting its radial displacement by adjusting the magnitude of the deflection field. The alignment is achieved by offline calibration.

The key performance criterion is the profile of peak ion transmission as a function of isolation width, where the isolation width is measured as the full-width at half maximum (FWHM). If the diameter of the aperture is greater than or equal to the aperture of the spot, the peak transmission is 100%. If the aperture is smaller than the spot, the transmission is the square of the ratio of the aperture diameter to the spot diameter.

The isolation width is most easily understood in units of displacement. If the spot is much larger than the aperture, then the edge of the spot cuts a nearly vertical line through the aperture as the spot moves horizontally. Thus, the spot fills half of the aperture when the left edge of the spot sits at the center of the aperture and half again when the right edge of the spot sits at the center of the aperture, meaning that the spot moved one spot diameter. If the spot is much smaller than the aperture, the situation is reversed: the intersection is half of the spot when the center of the spot passes the left edge of the aperture and half again when the center of the spot passes the right edge of the aperture, meaning that the spot moved one aperture diameter. The analysis is slightly different if the density of the spot varies with radius, but qualitatively similar.

The optimal situation is when the spot diameter equals the aperture diameter. In this case, the peak transmission is 100% and the FWHM is minimized. The value is approximately 0.808 spot diameters. Interestingly, making the aperture smaller than the spot reduces the peak ion transmission, but does not cause the FWHM to decrease; instead, it slightly increases towards the limit of one spot diameter. So, only the optimal case is considered where the aperture size is matched to the spot size.

The isolation width is converted from units of displacement to units of time (i.e., a time of flight difference) by calculating how long it takes for the aperture to move 0.808 spot diameters. One can think of the aperture moving away from an ion species that is slightly heavier and thus has a longer time of flight than the target ion. The isolation width is made narrower by decreasing the spot size (and the matched aperture) but improving ion focusing and/or moving the aperture faster.

The ultimate limit on how fast the aperture can move is the specific strength of the disk material. The specific strength of a material is the tensile strength of the material divided by its density. The tensile strength is the unit force that can be applied to a material per unit cross section before it breaks. Rotation of a uniform disk induces stress on the disk as a result of centrifugal force pulling outward on each volume element of the disk. The stress is maximal at the center of the disk, as forces are literally pulling outward in every direction. The stress is normal to the axis of rotation and proportional to the mass of volume elements exerting the stress by their rotation motion. The stress is also radially symmetric. As a result, the stress applied across any cross sectional area is proportional to the cross sectional area. Similarly, the stress is proportional to the density.

The stress on a rotating disk per unit cross sectional area divided by the density of the material, i.e., expressed so as to be comparable to the specific strength, is given by $(3+\mu)/8\ v^2$, where m is Poisson's ratio for the material, and v is the speed of a volume element at the edge of the disk. $v=\omega r$, where $\omega$ is the angular velocity and r is the radius of the disk. Poisson's ratio is a dimensionless quantity, indicating the negative ratio of transverse to axial strain for a given material. Poisson's ratio for many structural materials varies from 0.3 to 0.4.

The isolation width and the stress on the disk both depend on v, the product of $\omega$ and r. So, a disk can be spun half the radius at twice the speed, but it would have no effect on either the isolation width or the stress on the disk. Therefore, one parameter can be chosen, either the rotational frequency or the radius of the disk, independently, and the second factor is chosen by the constraint that the stress on the disk cannot exceed the specific strength of the disk's material.

The SI unit for specific strength is Pascal/(kg/m$^3$) or (N/m$^2$)/(kg/m$^3$). Because one newton (N) is equal to one kg-m/s$^2$, specific strength can also be expressed as m$^2$/s$^2$, i.e., in the units of squared speed. Specific strength can be interpreted in terms of the maximum speed at the edge of a uniform rotating disk tolerated by a material before breaking apart.

If the specific strength of a material is S, the maximum speed of the aperture on a disk made from that material is $v_{max}=(8S/(3+\mu))^{1/2}$. Choosing a material with four times greater specific strength allows us to rotate the disk twice as fast and reduces the isolation width by half.

JEOL has introduced rotor caps allowing the fastest magic angle spinning in solid-state NMR. In magic angle spinning, a solid sample is placed in a hollow cylindrical vessel and spun at very high frequencies. The high frequency spinning eliminates coupling between proton spins and their environments, which are disordered in a non-crystalline solid. Magic-angle spinning reduces the width of spectral lines in proportion to the rotational frequency. Larger vessels can hold more sample and thus improve signal-to-noise, and so performance in this application, also depends upon the product of w and r. JEOL offers a rotor cap with a 1-mm radius capable of spinning at 80 kHz, and recently introduced a 0.75-mm cap capable of spinning at 110 kHz, corresponding to edge speeds of 500 m/s and 520 m/s respectively.

Kevlar has a specific strength of 2.514e6 m$^2$/s$^2$. Its Poisson ratio is 0.36. Therefore, a rotating disk made of kevlar can be rotated to an edge speed of 2450 m/s or 2.45 um/ns before it breaks. This is the edge speed, for example, of a disk whose radius is 1 cm, rotating at 39.0 kHz.

If ions can be focused with the same m/z ratio into a 100 um diameter spot in the plane of the disk, then the FWHM of the isolation width in units of displacement is 80.8 um. For an aperture in a kevlar disk rotating at its maximum speed, the aperture takes 33 ns to move 80.8 um. This is the FWHM of the isolation window in time of flight.

Now, consider ions with m/z values ranging from 100 to 1600. In Apollo, for example, the relationship between time of flight and m/z is given by $m/z=(at)^2$, where $a=7.035e-3$ $Da^{1/2}/ns$. Therefore, $dm=2a(m/z)^{1/2}$ dt, where dm is the isolation width in mass corresponding to an isolation width in time. So, for m/z 100, each ns corresponds to a mass width of 14 mDa. At m/z 1600, each ns is 56 mDa. Therefore, isolation widths of 460 mDa to 1900 mDa can be achieved over this mass range with 100% peak transmission, i.e., 100% transmission of the target ion.

Unlike a quadrupole mass filter, the isolation width of the aperture-based filter scales with $(m/z)^{1/2}$ rather than (m/z). Another difference is that the isolation width cannot be reduced in exchanged for reduced ion transmission. Making the aperture smaller than the spot size reduces ion transmission, but does not reduce the isolation width; in fact, it can make the isolation width slightly larger.

There are three factors that reduce the isolation width: 1) increased rotation frequency, 2) increased beam focusing, and 3) increased flight times. The isolation width scales in proportion to the rotation period. To make the rotation period smaller, the disk need to be made out of a stronger material. Fortunately, nanotechnology is making progress in carbon-based materials, e.g., carbon nanotubes and graphene sheets. These materials may offer a factor of 100 or more in specific strength over kevlar and thus reduce the isolation widths by a factor of 10 or more.

The conversion of the isolation width in time to isolation width in units of m/z depends upon the time of flight calibration. Specifically, the isolation width in m/z can be reduced (for the same isolation time width) by increasing ion flight times, either by increasing the path length or slowing down the ions. Slowing down the ions axially provides benefits up to a point, until the axial and transaxial velocity spread of the ions start to become significant and adversely affect the focusing of ions. Because the resolving power requirements for mass filtering are considerably less than for mass analysis, it may be possible to reduce the accelerating potential significantly and still reduce the flight length to shrink the footprint of the mass filter.

In theory, the disk should be made as thin as possible. Note that the maximum edge speed before breaking is independent of the width of the disk. A thin disk requires proportionately less force to turn and reduces the deposit of ions on the walls of the aperture. However, if the disk is too thin, it may not have sufficient rigidity along the axis of rotation or may not be easily machined to uniform thickness, compromising its ability to rotate at constant frequency.

Ion transmission is reduced if ions pass through the front face of the aperture but crash into the side walls of the aperture rather than passing through the back face of the aperture. Ions of m/z 1600 with 10 kV of axial energy are traveling with an axial velocity of 22000 m/s. If the aperture is moving at 2450 m/s (as in the kevlar example), the aperture moves about ⅙ of the axial distance traveled by the ion. The axial velocities of lighter ions are higher. If the aperture is as deep as it is wide, e.g., 100 um, ion losses, from the extreme left and right edges of the spot as the aperture moves horizontally, are minimal, about 2% at m/z 1600 and 0.3% at m/z 100. If stronger materials become available allowing the aperture to move faster, the thickness of the disk should be reduced in proportion to the aperture velocity to prevent additional losses.

There are challenges involved in the rotation of the disk. The disk must rotate synchronously with the deflection field that achieves the spatial separation of the ions, allowing selection by the aperture. The position of the aperture on the disk should maintain a constant angular displacement with respect to the field over the time course of an experiment. The angular displacement can be adjusted or measured between experiments. A small dot of metal on the back of the disk can be tracked to measure the rotation of the disk. Their trajectories can be compared to the sinusoidal signal that drives the deflector.

The region in front of the disk is maintained at high vacuum as in a time of flight analyzer. The back side of the disk is a region where ions are cooled, collected, and eventually brought back together in a focused beam. Chamber walls sit in close proximity to the edge of the disk. A very small opening just beyond the edge of the disk is large enough to allow the disk to turn, but no larger, to reduce the pumping requirements needed to maintain the region in front of the disk at vacuum.

NMR spin rotors use bursts of air to push a small turbine on the rotor. Air power may be compatible with requirements of this system. A region behind the disk near its center can be partially walled off from the region near the edge of the disk to house a tube that provides the bursts of air required to spin the disk.

Deposition of ions on the disk is another potential problem. Fortunately, the desired ions are placed at the same radial displacement before selection. The vast majority of the ions that are desired to be selected can be blocked with a fixed disk with a ring-shaped aperture that allows only ions with the right radial displacement to pass. Ions that pass the ring-shaped aperture represent a larger than desired mass range. The target ions also have the right angular displacement. Ions outside the target region strike the rotating disk in a ring pattern extending in a narrow band around the disk on either side of the aperture. The deposits are roughly uniform around the ring so that any field produced by the deposits has little impact on the target ions as they pass through the aperture.

Because the stresses are considerably less at the edge of the disk compared with the center, it may be possible to place a thin layer of a different material on the surface of the disk covering a narrow ring where ion deposits may be expected. This surface material does not need to have the extremely high tensile strength of the bulk disk material and can be chosen to have other properties that minimize ion deposition and the resulting fields caused by residual deposits.

Ring-Shaped Aperture

Because of the extreme specific strength requirements for a rapidly rotating disk, alternatives are considered for selecting ions that involve rotation of electric fields rather than a mechanical rotation. One such embodiment is a stationary aperture followed by rotating electric deflection field that deflects (only) the target ion into a centrally located funnel that accepts the target ion.

Figure 7:
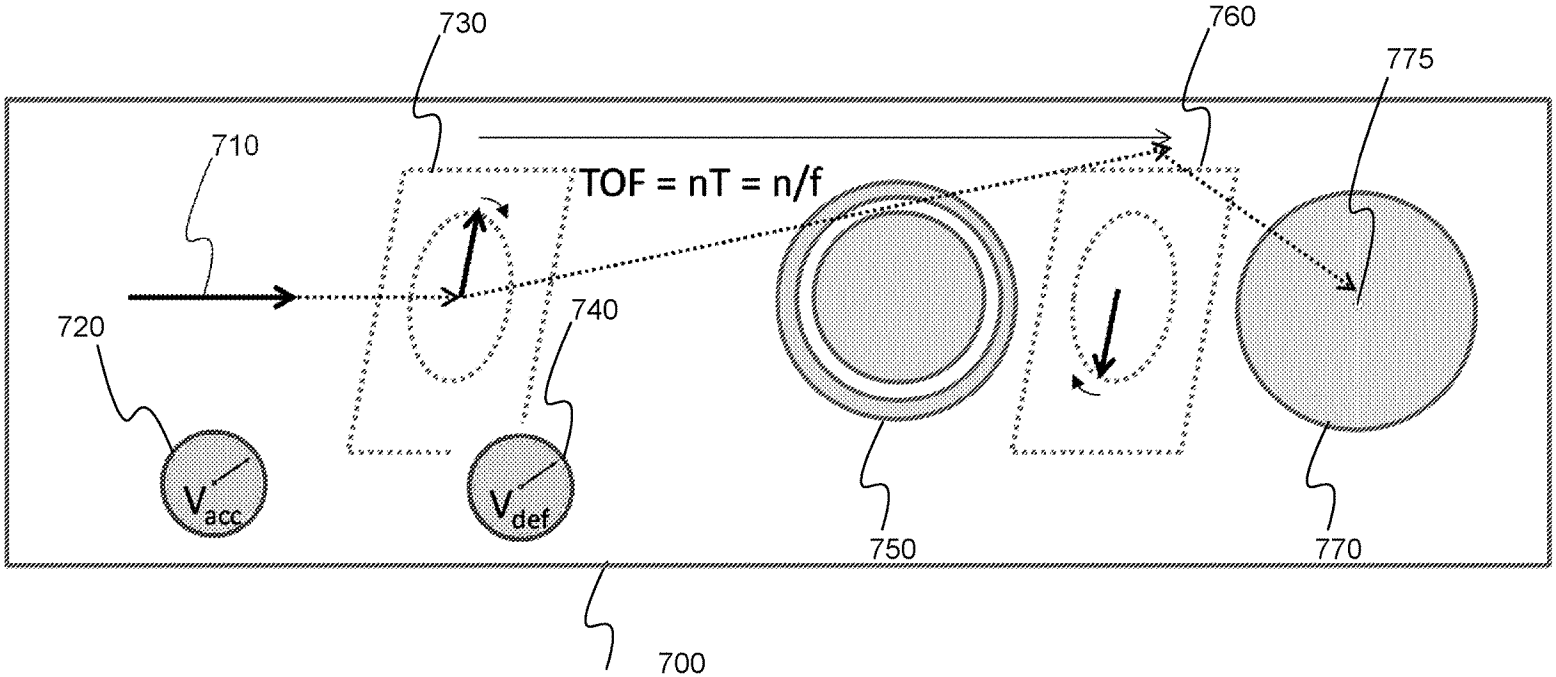
FIG. 7 is an exemplary diagram of a mass filter that includes two stationary apertures flanking a second rotating field, in accordance with various embodiments.

FIG. 7 is an exemplary diagram of a mass filter 700 that includes a stationary aperture followed by a second rotating field, in accordance with various embodiments. In mass filter 700, a continuous beam of accelerated ions 710, controlled by a tunable acceleration voltage ($V_{acc}$) 720, is directed into a rotating deflection field 730. The magnitude of the field is controlled by a tunable deflection voltage ($V_{def}$) 740, and ions in the continuous beam are separated by m/z.

In mass filter 700, the rotating aperture is replaced with two fixed apertures 750 and 770 sandwiched around a second rotating field 760. The first of these apertures 750 is annular and designed to transmit the desired ions along with no more than one ring of the spiral that it lies on. Next, rotating field 760 that is 180° out of phase with respect to the first field 730 deflects the desired ions back towards the center through a stationary pinhole aperture 775 of aperture 770.

As before, the acceleration voltage 720 is adjusted so that the time of flight is an integer number of rotation periods, but here the flight time is measured from the first deflection field to the second. The magnitude of deflection field 760 is also scaled so that the radial deflection of the desired ions is matched to the radial displacement of annular aperture 750. The same scaling is also applied to second deflection field 760.

In various embodiments, Aperture 770 is a collector funnel. Aperture 770 can be a metal shielding plate with a small orifice 775 that allows penetration of an electric field originating from behind the shielding plate. A small collimator (not shown) extending outward from orifice 775 can be used to shape the acceptance region of the collector. Ideally, ions of known energy originating from any point on a circle in the plane of the deflection field and passing through a small funnel-shaped region of space in front of the collimator pass through orifice 775.

The position of any given ion species in plane deflector field 760 used for selecting ions traces out a circle with a frequency governed by upstream deflector field 730 used to separate ions. Therefore, the required deflection field for selecting a target ion points from the position of the target ion inward toward the center of the circle, i.e., into the acceptance region of the collection funnel.

One way to set up conditions for selecting a target ion is to rotate the two deflector fields 730 and 760, the upstream analyzer and the downstream collector, synchronously, e.g., driven by the same input signal, and to control the time of flight of the target ion so that its time of flight is exactly one-half period more than an integer number of rotation periods. For example, suppose that both fields are pointing to 12 o'clock when the ion reaches the upstream analyzer field. After n+½ rotations of the fields, both fields are pointing to 6 o'clock when the ion reaches the downstream collector field. The action of collector field 760 opposes the action of analyzer field 730, bringing the ion back to the center. Another ion species with a different time of flight, i.e., n+x, has a displacement on the circle that makes an angle $2\pi x$ with the collector field, for example. It is directed away from the collection funnel, unless $x=½$.

Just as with the pinhole aperture, the time of flight of the target ion can be controlled to target for selection by making a small calculated adjustment to acceleration potential 720. In addition, fixed plate 750 with a circular slot just upstream from rotating collection field 730 is used to block ions that have times of flight of m+½, for some different integer m. Recall that analyzer field 730 places each ion at a radial displacement that varies monotonically with its time of flight. The radial acceptance interval is chosen to select the target ion, but block ions whose time of flight differs by as much as one rotation period.

Again, as with the pinhole aperture, the magnitude of analyzer deflection field 730 is scaled to bring the target ion to a desired radius, i.e., the radius of the circular slot. To maintain the same deflection angle from downstream collector field 760 to the collection funnel 770, the magnitude of downstream collector field 760 is also scaled in proportion to upstream analyzer defection field 730. To maintain the same acceptance region, the pulling field (not shown) is also proportionately scaled.

Both embodiments require precise alignment for optimal performance. Using a rotating field to deflect ions back to a fixed orifice rather than rotating the orifice to catch the ions allows the use of much higher rotational frequencies, which offers the potential of proportionately higher resolving power. The resolving power of a collection funnel depends upon the properties of its acceptance region. Ideally, the acceptance region is precisely matched to the cross section of the beam to provide 100% transmission of the target ion and minimal transmission of ions of adjacent m/z. In theory, the combination of the rotating deflector and collection funnel can offer the same performance as a fixed aperture at a given operation frequency. Thus, it can provide 100× greater resolving power when it is operated at MHz frequency rather than tens of kHz.

Mass Filter for Filtering a Continuous Beam of Ions

Figure 8:
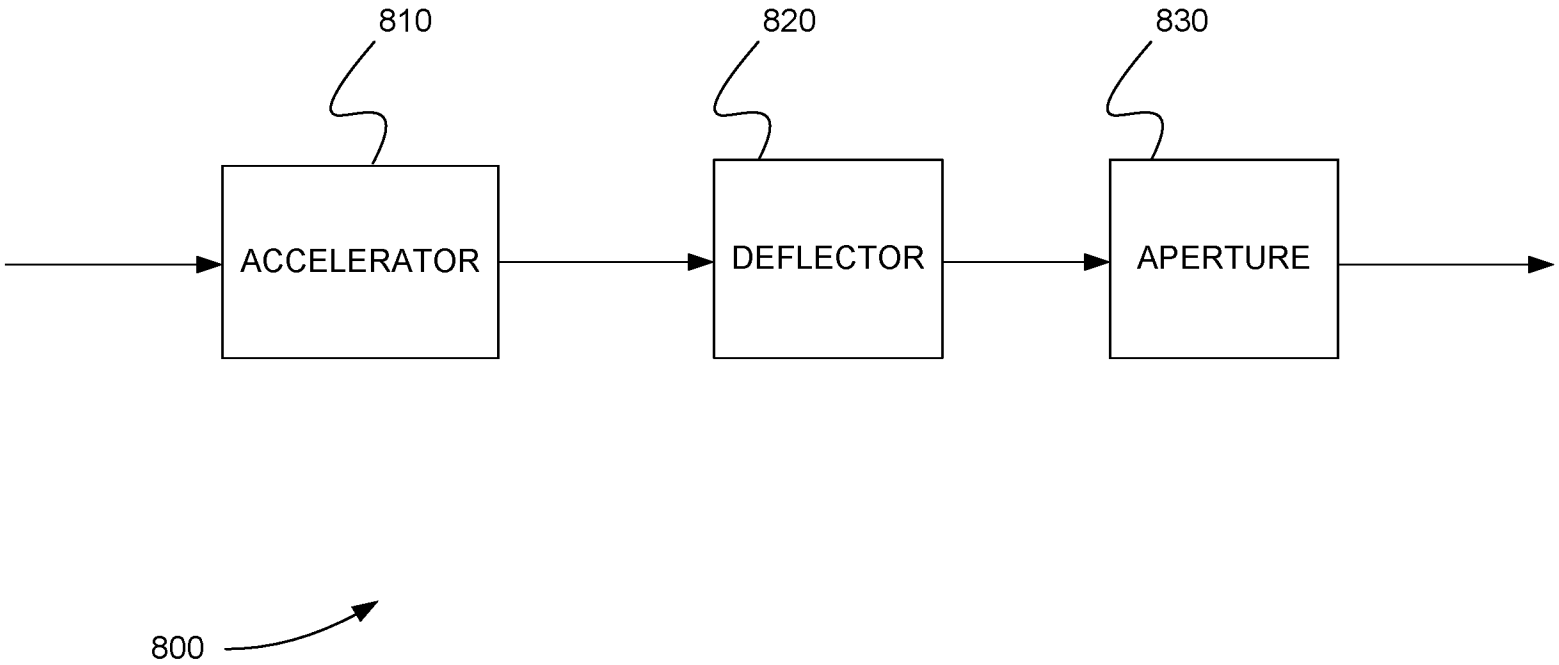
FIG. 8 is a schematic diagram showing a mass filter for filtering a continuous beam of ions, in accordance with various embodiments.

FIG. 8 is a schematic diagram showing a mass filter 800 for filtering a continuous beam of ions, in accordance with various embodiments. Mass filter 800 includes accelerator 810, deflector 820, and aperture 830. Mass filter 800 can also include a processor (not shown) in communication with one or more of accelerator 810, deflector 820, and aperture 830. The processor can be, but is not limited to, a computer, microprocessor, the computer system of FIG. 1, or any device capable of sending and receiving control information, processing data, and sending and receiving data.

Accelerator 810 receives a continuous beam of ions, and applies an acceleration electric field to the continuous beam of ions producing an accelerated beam of ions. Deflector 820 applies a field to the accelerated beam to separate ions in time and space producing a separated beam of ions. In various embodiments, deflector 820 applies a rotating field. The rotating field can be a rotating electric or magnetic field. In various alternative embodiments, deflector 820 applies a circulant rastering field.

Aperture 830 accepts only those ions from the separated beam whose m/z values lie within a range centered around a target m/z value. In various embodiments, aperture 830 can be a rotating disk with a pinhole aperture. The rotating disk is rotated at the same frequency as the rotating field is rotated, for example.

In various embodiments, the acceleration electric field is adjusted to select ions of a target m/z value so that when the time of flight from deflector 820 to aperture 830 for ions of the target m/z value is divided by the rotation period of the rotating field the remainder formed remains unchanged.

In various embodiments, the magnitude of the rotating field is scaled so that a radial deflection of ions in the separated beam with a target m/z value is matched to a radial displacement of a fixed pinhole of aperture 830.

In various embodiments, aperture 830 includes an annular aperture in a first stationary disk, a second deflector, and a pinhole aperture in the center of a second stationary disk. Ions in the separated beam whose mass-to-charge ratios lie within a range centered around a target m/z value pass through the annular aperture in the first stationary disk and are deflected by the second deflector that applies a second rotating field into the pinhole aperture in the center of the second stationary disk. The second deflector applies a field that is 180° out of phase with respect to the rotating field applied to the first deflector so that the ions whose mass-to-charge ratio lie in a range around a target m/z value are deflected to the pinhole aperture, for example. The acceleration electric field can be adjusted to select ions of a target m/z value so that the time-of-flight for ions of the target m/z value between deflector 820 and the second deflector is an integer multiple of the rotation period of the rotating field, for example. Also, the rotating field of deflector 820 can be scaled so that a radial deflection of ions in the separated beam with the target m/z value is matched to a radial displacement of the annular aperture.

In various embodiments, aperture 830 further includes a collimator extending outward from a pinhole of the pinhole aperture toward the second deflector and a collimating electric field that is applied on the side of the pinhole aperture opposite the collimator and penetrates the pinhole. The collimator and the collimating electric field produce a funnel-shaped region of space in front the collimator that directs ions to the pinhole, for example.

In various embodiments, if deflector 820 applies a circulant rastering field, aperture 830 can include a grid aperture to change the radius and the angular position of the ions accepted from the separated beam whose m/z values lie within a range centered around a target m/z value.

Method for Filtering a Continuous Beam of Ions

Figure 9:
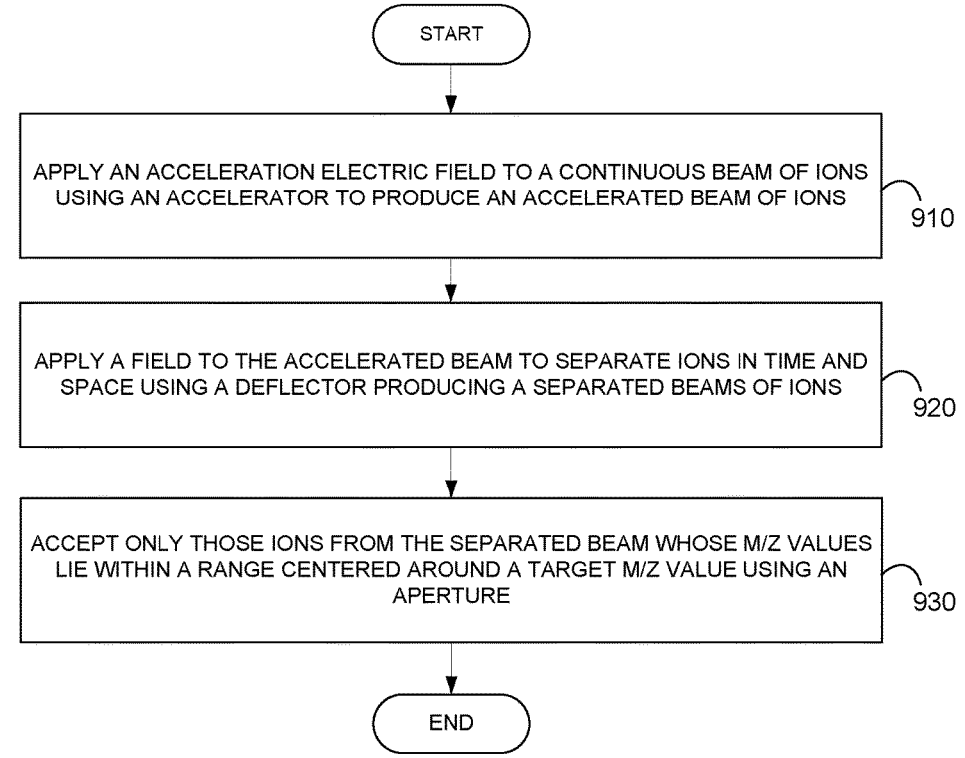
FIG. 9 is a flowchart showing a method for filtering a continuous beam of ions, in accordance with various embodiments.

FIG. 9 is a flowchart showing a method 900 for filtering a continuous beam of ions, in accordance with various embodiments.

In step 910 of method 900, an acceleration electric field is applied to a continuous beam of ions using an accelerator to produce an accelerated beam of ions.

In step 920, a field is applied to the accelerated beam to separate ions in time and space using a deflector producing a separated beam of ions.

In step 930, only accept those ions from the separated beam whose m/z values lie within a range centered around a target m/z value using an aperture.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass filter for filtering a continuous beam of ions, comprising:

an accelerator that receives a continuous beam of ions and applies an acceleration electric field to the continuous beam of ions producing an accelerated beam of ions;

a deflector that applies a rotating electric or magnetic field to the accelerated beam to separate ions in time and space producing a separated beam of ions; and an aperture that accepts only those ions from the separated beam whose m/z values lie within a range centered around a target m/z value, wherein the aperture comprises a rotating disk with a pinhole aperture.

2. The mass filter of claim 1 wherein the rotating disk is rotated at the same frequency as the rotating field is rotated.

3. The mass filter of claim 1 wherein the acceleration electric field is adjusted to select ions of a target m/z value so that when the time of flight from the deflector to the aperture for ions of the target m/z value is divided by the rotation period of the rotating field the remainder formed remains unchanged.

4. A mass filter for filtering a continuous beam of ions, comprising:

an accelerator that receives a continuous beam of ions and applies an acceleration electric field to the continuous beam of ions producing an accelerated beam of ions;

a deflector that applies a circulant rastering field to the accelerated beam to separate ions in time and space producing a separated beam of ions; and an aperture that accepts only those ions from the separated beam whose m/z values lie within a range centered around a target m/z value.

5. A method for filtering a continuous beam of ions comprising:

applying an acceleration electric field to a continuous beam of ions using an accelerator to produce an accelerated beam of ions;

applying a rotating electric or magnetic field to the accelerated beam to separate ions in time and space using a deflector producing a separated beam of ions; and accepting only those ions from the separated beam whose m/z values lie within a range centered around a target m/z value using an aperture, wherein the aperture comprises a rotating disk with a pinhole aperture.

6. The method of claim 5 wherein the rotating disk is rotated at the same frequency as the rotating field is rotated.

7. The method of claim 5 further comprising adjusting the acceleration electric field to select ions of a target m/z value so that when the time of flight from the deflector to the aperture for ions of the target m/z value is divided by the rotation period of the rotating field the remainder formed remains unchanged.

* * * * *